United States Patent [19]

Munroe

[11] Patent Number: 4,669,807

[45] **Date of Patent: * Jun. 2, 1987**

[54] PANEL-MOUNTED DUPLEX ELECTRICAL RECEPTACLE AND POWER TERMINAL STRIP

[75] Inventor: Ronald G. Munroe, Staten Island, N.Y.

[73] Assignee: Eagle Electric Mfg. Co., Inc., Long Island City, N.Y.

[ * ] Notice: The portion of the term of this patent subsequent to Aug. 26, 2003 has been disclaimed.

[21] Appl. No.: 778,210

[22] Filed: Sep. 20, 1985

Related U.S. Application Data

[62] Division of Ser. No. 685,392, Dec. 24, 1984, Pat. No. 4,607,906.

[51] Int. Cl.[4] ..... H01R 13/11

[52] U.S. Cl. ..... 439/787; 439/652; 439/907

[58] Field of Search ..... 339/20, 21 R, 22 R, 339/22 B, 23, 24, 166 R, 191 M, 192 R, 175 R, 276 SF, 14 R, 156 R, 256 R, 159 R, 159 C

[56] References Cited

U.S. PATENT DOCUMENTS

| | | | |
|---|---|---|---|
| 2,437,802 | 3/1948 | Adler | 339/191 M |
| 3,710,305 | 1/1973 | Clark | 339/166 R |
| 3,957,336 | 5/1976 | Bromberg | 339/192 R |
| 4,354,727 | 10/1982 | Brown | 339/192 R |

*Primary Examiner*—Gil Weidenfeld
*Assistant Examiner*—Gary F. Paumen
*Attorney, Agent, or Firm*—Kirschstein, Kirschstein, Ottinger & Israel

[57] ABSTRACT

A panel-mounted duplex electrical receptacle easily is ganged with another receptacle to form a power terminal strip of any desired length. Each receptacle is mounted with a snap action in a cutout formed in a panel. The receptacles are wired together by inserting a bare conductor into aligned channels formed in the receptacles. Resilient tongues are provided on contact strips provided within the receptacles for pressing the inserted conductor into electromechanical contact with the respective contact strip. A resilient tab on each receptacle lockingly retains the inserted conductor in each channel. Each contact strip is cut from a substantially planar preform in a scrapless manner.

3 Claims, 12 Drawing Figures

FIG. 1
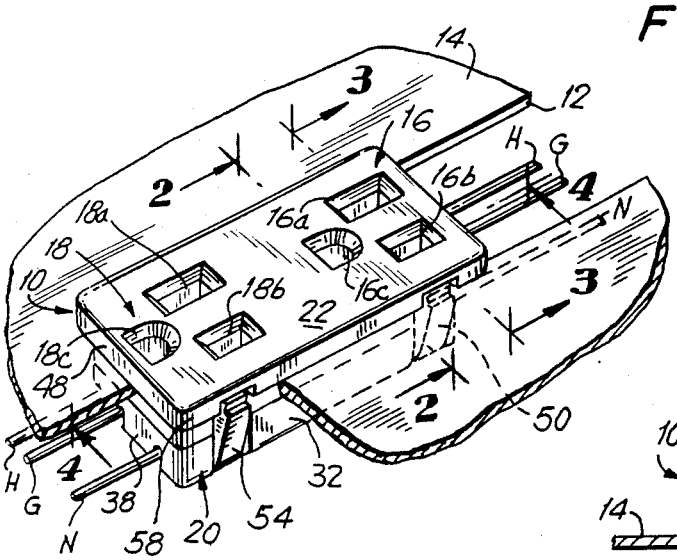
FIG. 2
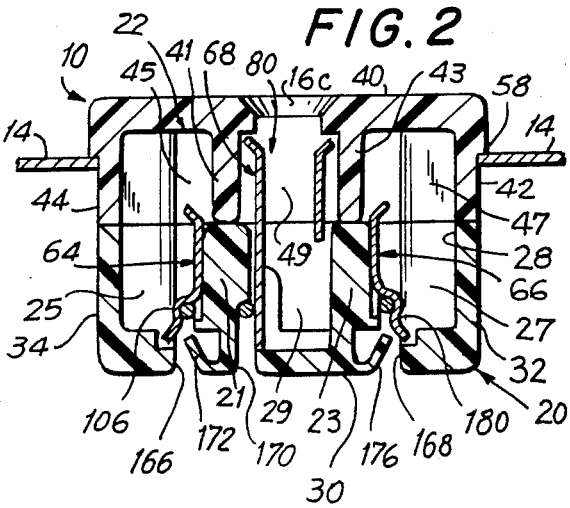
FIG. 2A
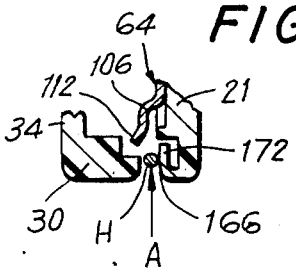
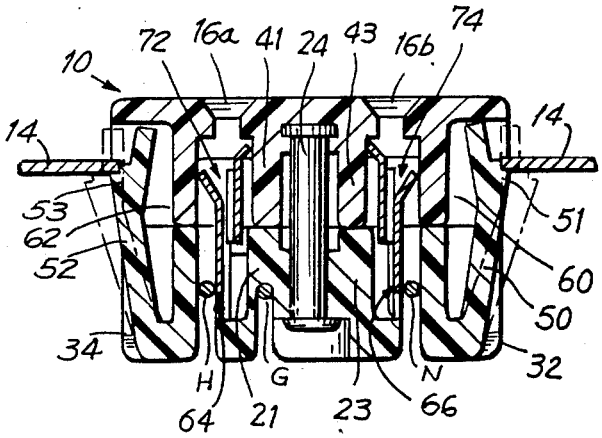
FIG. 3

FIG. 6
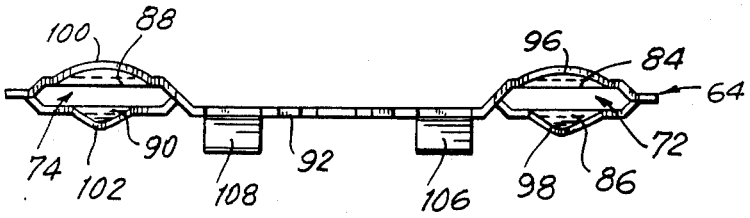
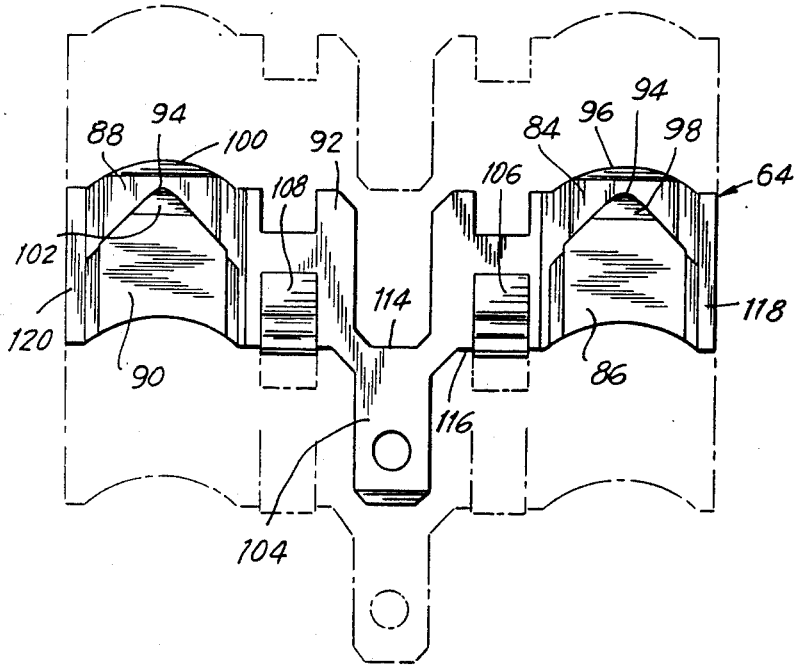
FIG. 7
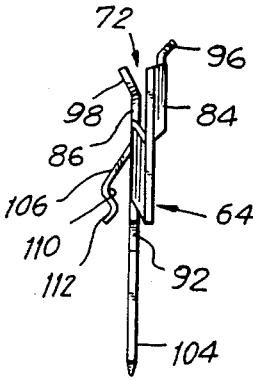
FIG. 8

FIG. 9
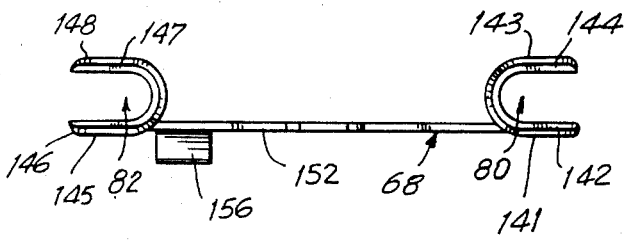
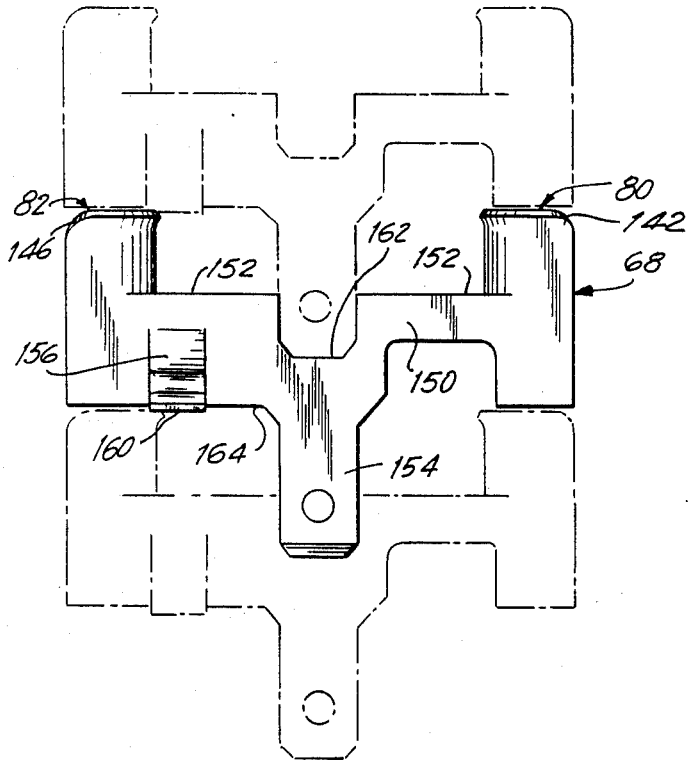
FIG. 10
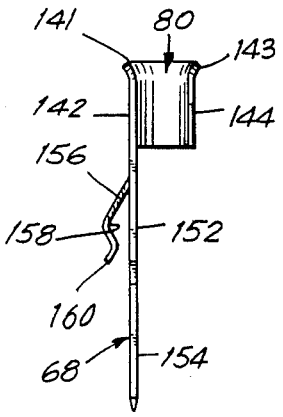
FIG. 11

PANEL-MOUNTED DUPLEX ELECTRICAL RECEPTACLE AND POWER TERMINAL STRIP

BACKGROUND OF THE INVENTION

This is a division of application Ser. No. 685,392 filed Dec. 24, 1984, now U.S. Pat. No. 4,607,906, issued Aug. 26, 1986.

1. Field of the Invention

This invention generally relates to an electrical receptacle and, more particularly, to a panel-mounted duplex receptacle which is capable of being ganged with additional such receptacles to form a power terminal strip. Still more particularly, this invention relates to a scrapless contact strip for use in such receptacles.

2. Decription of the Prior Art

Duplex electrical receptacles having two electrical outlets in each of which an electrical plug is insertable are well known. Such prior art receptacles were, however, not readily mounted in, nor removable from, a cutout formed in a panel. In addition, such prior art receptacles typically had to be individually terminated from one receptacle to the next by various time-consuming methods employing such components as screw terminals, solder lugs, push-on connectors, etc.

It also is well known to provide power terminal strips, each consisting of a plurality of electrical outlets arranged in a row to provide multiple tap-off points from which electrical power can be obtained. The prior art power terminal strips typically consisted of single outlets arranged in a row and interconnected in parallel. Although generally satisfactory for their intended purpose, such power terminal strips required twice as many terminations per individual outlet, and by their construction were expensive.

Also, such prior art receptacles frequently had exposed terminals extending out of their backs which required deep channels in the latter in order to provide the necessary minimum spacings between terminals. The individual termination of each receptacle in a terminal strip was burdensome and an added expense, and the additional wiring required to connect additional electrical outlets in a given power terminal strip was a laborious, painstaking, time-consuming and an expensive task.

It also is known from the prior art to provide electrically-conducting hot power, neutral power and ground contact strips within each electrical receptacle. These contact strips connect the outlets to an external source of electrical power. The known contact strips, however, were frequently of less efficient, single-wipe construction and incorporated terminating methods that required additional parts or labor needed to provide an accecptable connection between adjacent outlets.

SUMMARY OF THE INVENTION

1. Objects of the Invention

It is a general object of the present invention to overcome the aforementioned drawbacks of prior art electrical receptacles and power terminal strips or power taps.

It is another object of the present invention to provide a novel duplex electrical receptacle which readily can be mounted in, and readily removed from, a cutout formed in a panel.

It is a further object of the present invention to provide such an electrical receptacle which readily can be ganged with one or more receptacles to form a power terminal strip with any desired number of electrical outlets.

It is yet another object of the present invention to provide a novel electrical receptacle which either can be used alone or be quickly and easily wired to another receptacle to form a power terminal strip without resorting to extensive and expensive wiring techniques and laborious assembly procedures.

It is still another object of the present invention to provide a novel, scrapless, multi-function contact strip of one-piece construction for use in such receptacles.

It is yet another object of the present invention to provide such a contact strip having a double wipe socket for reliably electromechanically contacting each prong of an electrical plug, and also having a terminal for reliably electrically connecting the aforementioned socket to an exterior power supply.

It is yet a further object of the present invention to provide such a receptacle, power terminal strip and contact strip, each of which is easy to manufacture, easy to use, inexpensive in construction, durable in use, and reliable in operation.

2. Features of the Invention

In keeping with these objects and others which will become apparent hereinafter, one feature of the invention resides, briefly stated, in a panel-mounted electrical receptacle which comprises a housing elongated along a longitudinal direction and constituted of an electrically-insulating material such as synthetic plastic material. The housing has a support portion and a cover portion connected to the latter in an assembled condition.

The support portion has a generally planar base wall region, and side wall regions and end wall regions which extend along a transverse direction generally perpendicular to the plane of the base wall region away from the latter and bounding an interior space therewith. The base wall region has a plurality of channels extending from the interior space to the exterior of the support portion. Preferably, each channel is elongated lengthwise along the entire length of the base wall region, and has a longitudinal opening which faces the exterior of the support region and enables insertion along the transverse direction of an elongated conductor, preferably a bare copper wire, into a respective channel.

The cover portion had a generally planar top wall region which lies in generally mutual parallelism with the base wall region in the assembled condition. The top wall region has an electrical outlet (and in a duplex receptacle, two electrical outlets are provided) which extends from the interior space to the exterior of the cover portion.

A hot power contact strip, a neutral power contact strip and a ground contact strip each is constituted of an electrically-conducting material, e.g. brass or bronze, and is elongated along the longitudinal direction. The contact strips are mounted in the interior space on the support portion, and are spaced transversely apart from one another in mutual parallelism. Each contact strip has a double wipe socket (and in a duplex receptacle, two double wipe sockets are provided) for electromechanically receiving a respective prong of an electrical plug inserted in the electrical outlet. Each contact strip also has a transversely-extending terminal which extends through a respective channel of the base wall region and past the latter.

Each contact strip further has a longitudinally-extending body portion, and a resilient tongue having a conductor-receiving groove located within a respective channel. Each tongue is deflectable away from the body portion during insertion of a respective conductor into a respective channel and into a respective groove, and is returnable, due to its inherent resilience, toward the body portion to press the respective conductor into electromechanical contact with the latter and, preferably, the tongue urges the conductor along the entire length of the respective body portion.

In addition, a resilient tab of one piece with the base wall region is located within each channel adjacent a respective longitudinal opening of the support portion. Each tab is deflectable between a blocking position in which the tab, at least partially, overlies the conductor-receiving groove, and an access position in which the tab is clear of the groove. Once the conductor is received within the groove, and the tab has returned, due to its inherent resilience, to its blocking position overlying the groove, the tab serves to retain the inserted conductor in place within the channel with a snap-type locking action.

In order to mount the housing with a snap action in a cutout formed in a panel, at least two spaced-apart legs are provided on the housing for movement from an undeflected position to a deflected position, in the latter of which the legs snappingly engage the panel about the cutout. The snap-action legs readily permit the housing to be mounted on, and removed from, the panel cutout.

In accordance with another advantageous feature of this invention, the aforementioned electrical receptacle can be aligned with another identical receptacle such that the channels formed in the base wall region of one receptacle are colinearly arranged with the channels on the other receptacle. Thereupon, the insertion along the transverse direction of an elongated conductor into the colinearly arranged channels of the two receptacles, the reception of the inserted conductor into corresponding grooves formed in the resilient tongues within the aligned channels, and the locking retention of the inserted conductor permit the ready and simple assembly of a power terminal strip having any number of electrical outlets. In this manner, two, three, four or more electrical receptacles can be arranged in a row and wired by the simple expedient of inserting an electrical conductor of suitable length into the colinearly arranged and aligned channels of all the receptacles.

Yet another feature of this invention resides in the contact terminal strips used within the electrical receptacle. Each contact strip is cut from a substantially planar preform or blank. Each contact strip comprises a body portion of an electrically-conducting material, and is elongated along a longitudinal direction, and has opposite socket end regions and and intermediate region. A first and a second longitudinal edge are provided along the body portion. These longitudinal edges have complementary contours after cutting of the preform so that a plurality of contact strips can be cut from a single preform in a scrapless manner, i.e. with no or little waste material.

Each socket end region has transversely spaced-apart contact surfaces for electromechanically receiving therebetween a respective prong of an electrical plug in use of the receptacle. In one preferred embodiment, each socket end region is formed with a slit, and one of the contact surfaces is elevated relative to the other contact surface above the slit. This latter embodiment is of particular advantage when the contact strip is used as a hot power or a neutral power strip.

In the order preferred embodiment, which is of a special advantage when the strip is used as a ground contact strip, each socket end region is provided with a longitudinal slit, and one of the contact surfaces adjacent the slit is folded over an axis transverse to the slit, and is offset in parallel from the other contact surface.

The intermediate region of the body portion has a transversely-extending terminal of one piece with the socket end regions. The intermediate region has a generally planar body section, and at least one resilient tongue struck out of the plane of the body section. The tongue has a conductor-receiving groove at its free end region and is movable toward and away from the plane of the body section.

The just-described scrapless contact strip is inexpensive to form, and easy to assemble within the electrical receptacle. The double wipe socket of the contact strip makes a very reliable electromechanical engagement with a respective prong of an electrical plug. The terminal of the contact strip provides for a very reliable electrical connection to an external power supply. The unique design of each contact strip provides plenty of internal room within the receptacle and, hence, if desired, a pilot light to indicate "power on" may be located within the receptacle.

The novel feature which are considered as characteristic of the invention are set forth in particular in the appended claims. The invention itself, however, both as to its construction and its method of operation, together with additional objects and advantages thereof, best will be understood from the following description of specific embodiments when read in connection with the accompanying drawings.

BRIEF DESCRIPTION OF THE DRAWINGS

FIG. 1 is a perspective view of a duplex electrical receptacle mounted in a cutout of a broken-away panel prior to being ganged to another such receptacle to form a power terminal strip in accordance with this invention;

FIG. 2 is a sectional view taken along the line 2—2 of FIG. 1, showing electrical conductors fully inserted and retained within channels formed in the receptacle;

FIG. 2A is a fragmentary view analogous to FIG. 2, showing the wires during insertion into the channels;

FIG. 3 is a sectional view taken along the line 3—3 of FIG. 1;

FIG. 6 is a top plan view of a power contact strip for use in the receptacle of FIG. 1;

FIG. 7 is a front view of the power contact strip of FIG. 6, showing in phantom lines additional power contact strips to be cut from a substantially planar preform;

FIG. 8 is a side view of the power strip of FIG. 7;

FIG. 9 is a top plan view of a ground contact strip for use in the receptacle of FIG. 1;

FIG. 10 is a front view of the ground contact strip of FIG. 9, showing in phantom lines additional ground contact strips to be cut from a substantially planar preform; and FIG. 11 is a side view of the ground contact strip of FIG. 10.

DETAILED DESCRIPTION OF THE PREFERRED EMBODIMENT

Figure 4:
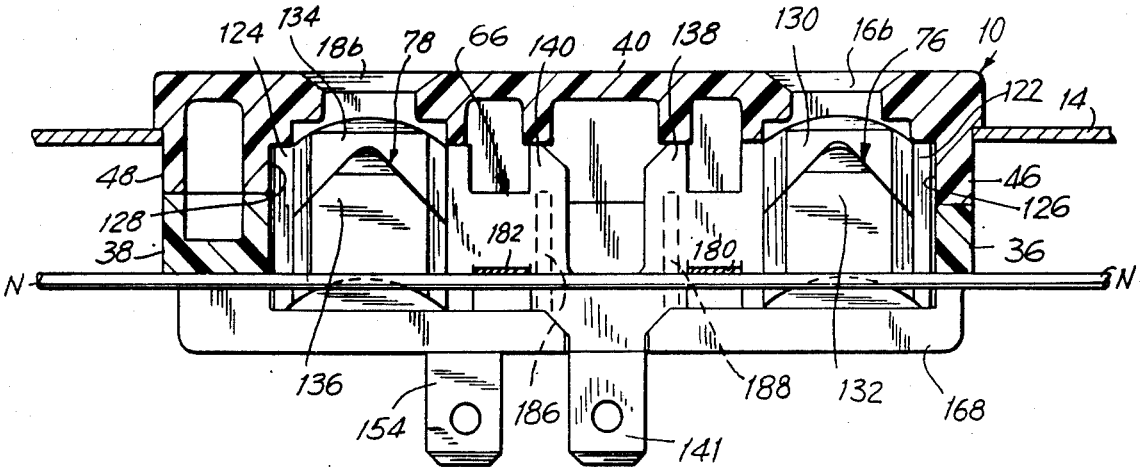
FIG. 4 is an enlarged longitudinal sectional view taken along the line 4—4 of FIG. 1.

Referring now to the drawings and, more particularly, to FIGS. 1-4, reference numeral 10 generally identifies a duplex electrical receptacle insertably mounted in a cutout 12 formed in panel 14. The receptacle is elongated along a longitudinal direction, and has a first electrical outlet 16 located at one end region of the receptacle, and a second electrical outlet 18 located at the opposite end region of the receptacle. The receptacle is constructed of an electrically-insulating material, e.g. synthetic plastic material. The receptacle is of bipartite construction, and includes a support portion or base 20 and a cover portion or top 22. In an assembled condition, the base and top securely are interconnected, preferably by being pinned together by rivet pins 24, 26 (see FIG. 5).

The base 20 has a generally planar base wall region 30, a pair of generally planar side wall regions 32, 34 and a pair of generally planar end wall regions 36, 38. The side and end wall regions of the base extend upwardly along a transverse direction generally perpendicular to the plane of the base wall region 30 away from the latter, and bound an interior space 28 therewith. The side and end wall regions of the base form a generally rectangular frame whose lower end is closed by the base wall region 30, and whose upper end is open and overlaid by the top 22 in the assembled condition. The base 20 also has interior longitudinally-extending, generally planar lower partition walls 21, 23 which are spaced transversely apart from each other, and which lie in mutual parallelism with the side walls 32, 34. The lower partition walls 21, 23 subdivide the interior space 28 of the base 20 into a first elongated lower compartment 25, a second elongated lower compartment 27, and a third elongated lower central compartment 29 between the compartment 25, 27. As described below, three electrically conductive elongated contact strips respectively are mounted in and along a respective one of the lower compartments 25, 27 29 prior to assembling the top 22 over the base 20.

The top 22 has a generally planar top wall region 40, a pair of generally planar side wall regions 42, 44, and a pair of generally planar end wall regions 46, 48. The side and end wall regions of the top 22 extend downwardly along the transverse direction generally perpendicular to the top wall region 40 away from the same. In the assembled condition, the top wall region 40 is parallel to and spaced from the base wall region 30; the top side wall regions 42, 44 are coplanar with the base side wall regions 32, 34 respectively; and the top end wall regions 46, 48 are coplanar with the base end wall regions 36, 38, respectively. The top 22 also has interior longitudinally-extending upper partition walls 41, 43 which are spaced transversely apart from each other, and which lie in a mutual parallelism with the top side wall regions 42, 44. The upper partition walls 41, 43 subdivide the interior space of the top 22, which interior space is bounded by a generally rectangular frame bordered by the side and end wall regions and the top into a first elongated upper compartment 45, a second elongated upper compartment 47, and a third elongated upper central compartment 49 between the compartments 45, 47.

In the assembled condition, the upper partitions 41, 43 generally are coplanar with, and extend transversely toward, the lower partitions 21, 23, so that the first upper and lower compartments 45, 25 are juxtaposed and form a single first compartment, the second upper and lower compartments 47, 27 are juxtaposed and form a single second compartment, and the third upper and lower central compartments 49, 29 are juxtaposed and form a single third central compartment. As described below, the contact strips mounted in the lower compartments 25, 27, 29 extend transversely upwardly into the respectively juxtaposed upper compartments 45, 47, 49.

The overall shape of the assembled receptacle 10 is a parallelepiped and, as shown in FIG. 1, the cutout 12 has a generally rectangular outline. Snap-action legs are provided at the exterior of the receptacle for mounting the same with a snap-type action in the panel cutout 12. A first pair of snap-action legs 50, 52 are provided at opposite lateral sides of outlet 16, and a second pair of snap-action legs 54, 56 are provided at the opposite lateral sides of outlet 18. Each leg is of one-piece, molded-plastic construction with the base 20. Each pair of legs is movable from an undeflected position, shown in FIG. 3 in dashed lines, in which the respective pair of legs are spaced apart from each other by a predetermined distance, to a deflected position, shown in FIG. 3 in solid lines, in which the respective pair of legs are moved toward each other to a distance smaller than said predetermined distance and in which the respective pair of legs snappingly engage the portions of the panel 14 about the cutout 12. As shown in FIG. 3, representative legs 50, 52 have outwardly flared shoulders 51, 53 as considered in the direction of insertion of the receptacle into the cutout 12.

During the insertion of the receptacle from above the cutout, the portions of the panel surrounding and bordering the cutout 12 push the respective pair of legs from their undeflected toward their deflected positions. As the panel portions ride along the flared shoulders 51, 53, the legs 50, 52 are moved further toward each other until, eventually, the shoulders 51, 53 clear the panel portions, and thereupon the legs, due to their inherent resilience, snap back and act to return the legs toward their undeflected position and, concomitantly, cause the upper surfaces of the shoulders 51, 53 to snap outwardly and engage the underside of the panel 14. The top 22 has an undercut lip 58 extending around the periphery thereof. The lip 58 engages the upper side of the panel 14 in the snapped-in deflected position of the legs.

Each leg extends upwardly from the base wall region 30 along the direction of insertion toward, but terminating short of, the top wall region 40. As shown in FIG. 3, the legs 50, 52 when being moved toward their deflected position, enter, at least partially, into transversely-extending clearance slots 60, 62 formed in the side wall regions 32, 42 and 34, 44 respectively. In the panel-mounted condition, the upper ends of the clearance slots 60, 62 extend upwardly above the panel 14 and, hence, these upper ends serve as convenient tool receiving slots into which a tool, e.g. a screwdriver, may be inserted to push the respective pair of legs even deeper into the respective clearance slots until the shoulders 51, 53 once again clear the panel 14, so that the receptable 10 easily can be removed therefrom. Advantageously, the four legs are located adjacent the four corner regions of the receptacle 10 to provide a very stable mounting.

In conventional manner, electrical outlets 16, 18 each have a first longer rectangular aperture **16*a*, 18*a* for respectively receiving a hot power planar prong of an electrical plug, a second shorter rectangular aperture 16b, 18b for respectively receiving a neutral power planar prong of the plug, and a third D-shaped aperture 16c, 18c** for respectively receiving a ground D-shaped prong of the plug.

As noted previously, a first elongated contact strip 64 is mounted in the first compartment 25, 45, and is connectable, as described below, to a hot power output of an external power supply, and hereinafter will be known as the hot strip. A second elongated contact strip 66 is mounted in the second compartment 27, 47, and is connectable to a neutral power output of the power supply, and hereinafter will be known as the neutral strip. A third elongated contact strip 68 is mounted in the third compartment 29, 49, and is connectable to a ground output of the power supply, and hereinafter will be known as the ground strip. The hot and neutral strips 64, 66 are identical and, for the sake of brevity, only the representative strip 64 has been shown in isolation in FIGS. 6–8. The ground strip 68 is shown in isolation in FIGS. 9–11. Each strip 64, 66, 68 is constituted of an electrically-conductive material, for example, copper or a bronze alloy, and is elongated lengthwise along the longitudinal direction. The strips 64, 66, 68 are spaced transversely apart from each other in mutual parallelism. Each strip has a double wipe socket underneath a respective aperture in a respective outlet for electromechanically receiving a respective prong of the electrical plug inserted into the respective outlet. Thus, hot strip 64 has sockets 72, 74 which are mounted underneath apertures 16a, 18a, neutral strip 66 has sockets 76, 78 which are mounted underneath apertures 16b, 18b, and ground strip 68 has sockets 80, 82 which are mounted underneath apertures 16c, 18c.

Turning, then, to representative power strip 64 in FIGS. 6–8, the double wipe socket 72 has a pair of contact surfaces 84, 86 spaced transversely apart so as to engage both sides of a hot power prong of one electrical plug. The double wipe socket 74 has a pair of contact surfaces 88, 90 transversely spaced apart thereby to engage both sides of a hot power prong of another electrical plug. The hot strip 64 initially is cut, preferably by stamping, out of a substantially planar pre-form or blank, and has a substantially planar elongated body portion 92 from which various sections are displaced out of the plane of the body portion 92. Thus, a pair of inverted V-shaped slits 94 are cut in each end region of the body portion 92. The sections of the body portion 92 above each slit 94 are displaced into the plane of FIG. 7, thereby respectively to constitute the contact surfaces 84, 88. The sections of the body portion below each slit 94 are displaced out of the plane of FIG. 7, i.e. toward the viewer, thereby respectively to constitute the contact surfaces 86, 90. Upper edges 96, 98 of contact surfaces 84, 86 are flared outwardly to facilitate insertion of a prong into the socket 72. Analogously, the contact surfaces 88, 90 have their upper edges 100, 102 flared to facilitate insertion of a prong into the socket 74.

Intermediate the sockets 72, 74 of hot power strip 64 is a transversely-extending terminal 104 which lies in the same plane as the body portion 92. As explained below, the hot terminal 104 is connected to a hot power output of an external power supply, and constitutes a conductive path from the hot power output to both hot sockets 72, 74.

Also provided on the body portion 92 are a pair of resilient tongues 106, 108 struck out of the plane of the body portion 92. Each tongue is cut at opposite lateral sides along vertical slits so that each tongue has a generally rectangular outline. As shown in FIG. 8, representative tongue 106 has a semi-circular conductor-receiving groove 110 for a purpose described below, and a flared free end or tip 112.

As shown in FIG. 7, the power strip 64 has an upper longitudinal edge 114 and a lower longitudinal edge 116, each edge running lengthwise along the entire length of the power strip 64. In addition, the power strip 64 has a pair of transverse edges 118, 120 at the end of the strip. The upper and lower longitudinal edges 114, 116 have the same contour or outline, so that a pluraity of contact strips, as shown by phantom lines in FIG. 7, each being identical in shape to strip 64, can be stamped in a row out of the same pre-form without any waste material being left over in the process. In other words, a plurality of contact strips can be formed from a single planar pre-form in a scrapless manner. After the contact strips 64 are cut, each thereupon can be appropriately slit, and then the sections of the strip adjacent the slits can be displaced, as desired, to form the above-described contact surfaces 84, 86 and 88, 90 and the resilient tongues 106, 108.

Due to the identity in structure between the hot strip 64 and the neutral strip 66, the mounting of the strip 66 in FIG. 4 between the base 20 and the top 22 is, of course, the same for strip 64. Thus, neutral strip 66 has transversely-extending edges 122, 24, analogous to edges 118, 120 of the ground strip 64. The transverse edges 122, 124 are captured between walls bounding a pair of recesses 126, 128 and retained in place thereat. Contact surfaces 130, 132 of the socket 76 are located beneath aperture 16b, and contact surfaces 134, 136 of the socket 78 are located beneath aperture 18b. In addition, upstanding sections 138, 140 are engaged by corresponding depending projections on the underside of the top wall region 40, thereby to prevent the strip 66 from moving in the transverse direction. The neutral strip 66 also has a transversely-extending terminal 141 analogous to terminal 104 but connectable to a neutral output of the exterior power supply, and thereby constitutes a conductive path from the neutral power output of the power supply to both neutral sockets 76, 78.

Turning, next, to FIGS. 9–11, the double wipe sockets 80, 82 of the ground strip 68 have transversely spaced-apart contact surfaces 142, 144 and 146, 148 so as respectively to engage both sides of a respective ground prong of an electrical plug. As with the power strips 64, 66, the ground strip 68 initially is cut, preferably by being stamped, out of a substantially planar preform or blank, and has a substantially planar elongated body portion 150 from which various sections thereof are displaced out of the plane of the body portion 150. Thus, a linear slit 152 is cut into each end region of the body portion 150 lengthwise of the same. The sections of the body portion 150 above each slit 152 is folded over a fold line that extends generally perpendicular to the respective linear slit 152 such that the contact surfaces 144, 148 are offset from, and lie behind and generally parallel to, the contact surfaces 142, 146, respectively. Upper edges 141, 143 of contact surfaces 142, 144 are flared outwardly to facilitate insertion of one prong into the socket 80, and upper edges 145, 147 of contact surfaces 146, 148 similarly are flared outwardly to facilitate insertion of another prong into the socket 82. Advantageously, the sockets 80, 82 have a generally U-shaped cross-section. A transversely-extending terminal 154 which lies in the plane of the body portion 150 is provided between the sockets 80, 82, and is connected to a ground output of an external power supply, thereby to constitute an electrically-conductive path from the ground output to the ground sockets 80, 82.

In addition, a resilient tongue 156 is struck out of the plane of the body portion 150 and, as shown in FIG. 11, the tongue 156 has a semi-circular conductor-receiving groove 158 and a flared free end or tip 160. The ground strip 68 also has, as shown in FIG. 10, an upper longitudinal edge 162 and a lower longitudinal edge 164, each edge running along the entire length of the upper and lower portions of the ground strip 68. The upper and lower longitudinal edges 162, 164 have complementary contours at the time that the pre-form is being cut, i.e. prior to any sections of the ground strip 68 being displaced out ot the plane of the body portion 150, so that a plurality of ground strips, as shown in phantom lines in FIG. 10, all strips being identical in structure to that of strip 68, can be cut and stamped out of the same pre-form in a row without any waste material being left over, thereby enabling the ground strip 68, just like the hot and neutral strips 64, 66, to be formed in a scrapless manner. After the ground strips are cut, each can be slit, and then the sections adjacent the slits can be displaced, as desired, to form the contact surfaces 142, 144 and 146, 148 and the resilient tongue 156. The ground strip 68 is mounted in the juxtaposed central compartments 49, 29 between the top 22 and the base 20, so that the contact surfaces 142, 144 are located beneath aperture 16*c*, and so that the contact surfaces 146, 148 are located beneath aperture 18*c*.

Referring now to FIG. 2, the base wall region 30 of the base 20 is provided with a plurality of longitudinally extending channels 166, 168, 170, each channel extending lengthwise along the entire length of the base wall region 30, and each channel extending transversely from the interior space 28 to the exterior of the wall region 30. Each channel has a longitudinal opening which faces the exterior of the base wall region 30, and enables the insertion along the transverse direction of a respective elongated bare wire or conductor H, a second neutral conductor N, and a third ground conductor G, respectively, are inserted through the openings of channels 166, 168, 170 and into the interior of the same. A pair of resilient tabs 172, 174 are located within, and are longitudinally-spaced along, the channel 166 adjacent its longitudinal opening. Each tab is molded of a one-piece construction with the base wall region 30, and each tab is deflectable between a blocking position, shown in FIG. 2, in which representative tab 172 overlies, at least partically, the conductor-receiving groove 110 of the tongue 106, and an access position, shown in FIG. 2A, in which representative tab 172 is clear of the groove 110. As shown in FIG. 2A, during the insertion of representative H conductor into channel 166 along the direction of the arrow A, the H conductor, which preferably is constituted of copper or a bronze alloy, deflects the tab 172 from its initial unstressed angled position blocking the channel 166 to a stressed, generally vertical, position in which the tab 172 is remote from the channel 166, and permits entry of the H conductor therein. Further insertion of the H conductor in the direction of the arrow A causes the H conductor to engage the tip 112 of the tongue 106 and deflect the latter from its original, slightly angled position overlying the channel to a more angled, deflected position in which the conductor-receiving groove 110 is accessible to the H conductor and, in fact, receives the same. Once the H conductor passes the tab 172, the latter snaps back, due to its inherent resilience, to its initial blocking position overlying the channel 166, thereby to prevent the H conductor from falling out of the channel. Once the H conductor passes the tip 112, the tongue 106 snaps back, due to its inherent resilience, toward its original position in which it now passes the H conductor into electromechanical contact with the hot strip 64 and, preferably, along the entire length of the body portion 92 thereof, in order to ensure a firm engagement along the entire length of the hot strip 64. The above-described cooperation between the tab 172 and the tongue 106 also is valid for the tab 174 and the tongue 108, so that the H conductor reliably is held in two places along and within the channel 166.

In exactly analogous manner, a pair of resilient tabs 176, 178, which are identical to tabs 172, 174, cooperate with resilient tongues 180, 182, which are identical to tongues 106, 108, to retain the N conductor with a snap-type action within channel 168, and to press the N conductor into an electromechanical line contact along the length of the body portion of the neutral strip 66. The line contact engagement between the N conductor and the neutral strip 66 best is shown in FIG. 4.

In the same manner, another resilient tab 184 cooperates with the tongue 156 to retain the G conductor with a snap-type action within the channel 170, and to press the G conductor into an electromechanical line contact along the length of the body portion of the ground strip 68.

The aforementioned hot power terminal 104, neutral power terminal 141 and ground terminal 154 also respectively extend and project through the hot, neutral and ground channels 166, 168, 170. Thus, the terminals 104, 141, 154, which are so positioned in their respective channels so that they assume the conventional orientation of the prongs of an electrical plug, may be inserted into a conventional, non-illustrated, socket of an external power supply, so that the hot, neutral and ground outputs thereof can be conducted from the respective terminals to their respective sockets. A user may insert an electrical plug into either one or both of the outlets 16, 18 and tap electrical power therefrom.

Figure 5:
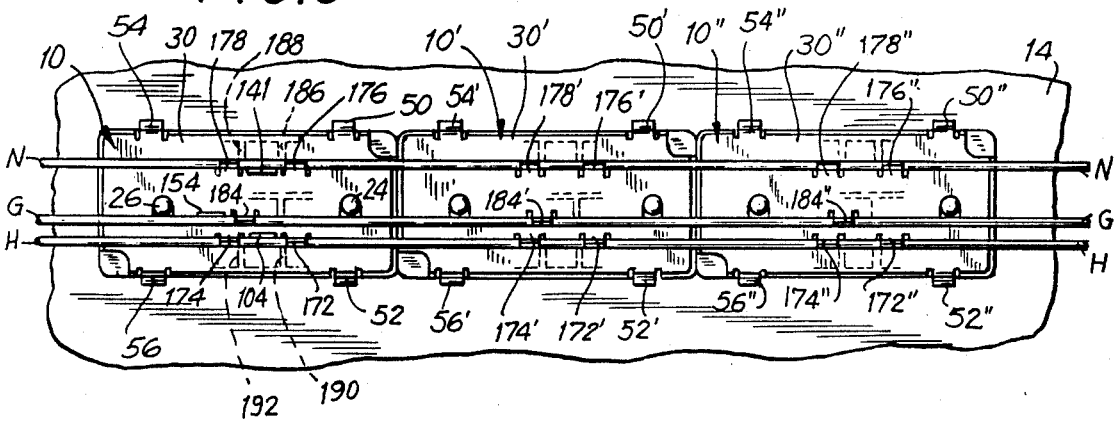
FIG. 5 is a bottom plan view of electrical receptacles ganged to form a power terminal strip in accordance with this invention.

As described so far, a single duplex receptacle 10 may be inserted in a panel cutout by snap-type action. If it is not desired to add, or gang, additional receptacles to increase the number of electrical outlets available at the panel, then there is no need insertably to mount the H, N, G conductors in their respective channels. However, if it further is desired to add additional outlets, then, as shown in FIG. 5, a first additional receptacle 10', and a second additional receptacle 10'', if desired, may be oriented in the panel cutout 12 so that the hot, neutral and ground channels of receptacle 10' and 10'' are colinearly arranged and aligned with the hot, neutral and ground channels of receptacle 10, so that the H, N, G conductors may be individually inserted simultaneously in and along the aligned channels, thereby to simply and quickly electrically interconnect all of the receptacles. The receptacles 10' and 10'' are identical to receptacle 10, with the exception that the terminals 104, 141, 154 need not be provided on receptacles 10', 10''. When constituting a power tap or strip of multiple receptacles, it only is necessary for one of the receptacles, e.g. receptacle 10, to have the three terminals requisite for connection to the hot, neutral and ground outputs of the external power supply. The other receptacles, e.g. 10', 10″, need not have such terminals and, hence, they conveniently are cut off prior to the contact strips being mounted within the receptacles 10′, 10″. The H, N, G conductors themselves serve as bus bars to make the necessary electrical interconnection between all of the receptacles of the power tap. Otherwise, the receptacles 10′ and 10″ are exactly identical in structure and function as that of receptacle 10 and, therefore, like component parts of receptacles 10′ and 10″ have been identified with primed and double primed numerals, respectively, to identify like parts with that of receptacle 10.

In order firmly to secure the contact strips against lateral shifting, transversely-extending ribs 186, 188 are provided within juxtaposed compartments 27, 47, and transversely-extending ribs 190, 192 are provided in juxtaposed compartments 25, 45. Ribs 186, 188 bear against the body portion of neutral strip 66 and urge the latter against the partition 23, as best shown in FIG. 2, to prevent lateral shifting of the strip 66. Analogously, ribs 190, 192 bear against the body portion of hot strip 64 and urge the latter against partition 21, as also shown in FIG. 2, to prevent lateral shifting of the hot strip 64.

The receptacle shown in FIG. 1 can be used alone as a single duplex receptacle mounted in a panel cutout, or, as shown in FIG. 5, can be ganged with one or more other receptacles to form a series power tap. The series power tap of this invention permits one readily to increase or decrease the number of electrical outlets to be made available at a particular installation. The H, N and G conductors interconnecting multiple receptacles serve as bus bar terminations which are located inside the receptacles, thereby providing better spacing and greater contact area as compared to prior art designs. Since such terminations are made by simply snapping the bus bars into the channels, many terminations can be made in a fraction of the time it took to make one prior art termination.

It will be understood that each of the elements described above, or two or more together, may also find a useful application in other types of constructions differing from the types described above.

While the invention has been illustrated and described as embodied in a panel-mounted duplex electrical receptacle and power terminal strip, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

I claim:

1. A scrapless contact terminal strip cut from a substantially planar preform, for use in a duplex electrical receptacle, comprising:

a body portion of electrically-conducting material, and elongated along a longitudinal direction and having opposite socket end regions and an intermediate region, said body portion having a first and a second longitudinal edge which have complementary contours after cutting of the preform, each socket end region having transversely spaced-apart contact surfaces for electromechanically receiving there-between a respective prong of an electrical plug said intermediate region having a transversely-extending terminal of one piece with the socket end regions, and said intermediate region having a generally planar body section, and at least one resilient tongue struck out of the plane of the body section, said tongue having a conductor-receiving groove at its free end region and being movable toward and away from the plane of the body section.

2. The contact terminal strip as recited in claim 1 wherein each socket end region has a slit, and wherein one of the contact surfaces is elevated relative to the other contact surface above the slit.

3. The contact terminal strip as recited in claim 1 wherein each socket end region has a longitudinal slit, and wherein one of the contact surfaces adjacent the slit is folded over an axis transverse to the slit, and offset in parallel from the other contact surface.

* * * * *